United States Patent [19]

Holley

[11] Patent Number: 4,884,841

[45] Date of Patent: Dec. 5, 1989

[54] SEATING ASSISTANCE DEVICE

[76] Inventor: Robert E. Holley, P.O. Box 1669, Angleton, Tex. 77515

[21] Appl. No.: 209,063

[22] Filed: Jun. 20, 1988

[51] Int. Cl.[4] ..... A47C 1/02

[52] U.S. Cl. ..... 297/331; 297/DIG. 10; 297/347; 297/DIG. 3

[58] Field of Search ..... 297/DIG. 10, 332, 338, 297/347, DIG. 3, 331; 4/251

[56] References Cited

U.S. PATENT DOCUMENTS

| | | | |
|---|---|---|---|
| 1,488,206 | 3/1924 | Koenigkramer | 297/347 X |
| 1,856,691 | 5/1932 | Carter | 297/347 |
| 2,442,303 | 5/1948 | Mayfield | 297/DIG. 10 |
| 3,925,833 | 12/1975 | Hunter | 297/DIG. 10 |
| 3,964,786 | 6/1976 | Mashuda | 297/DIG. 10 |
| 4,185,335 | 1/1980 | Alvis | 297/DIG. 10 |
| 4,545,616 | 10/1985 | Booth | 297/DIG. 10 |

FOREIGN PATENT DOCUMENTS

| | | | |
|---|---|---|---|
| 2625046 | 12/1977 | Fed. Rep. of Germany | 297/DIG. 10 |
| 2019861 | 7/1983 | France | 297/DIG. 10 |

*Primary Examiner*—Francis K. Zugel
*Attorney, Agent, or Firm*—Bernard A. Reiter

[57] ABSTRACT

A device for assisting invalids into and from a seated position, e.g., over a toilet. The device has a frame and a seat hingedly attached at the front thereof to a support member which is vertically slidable on the frame. A stop is associated with the hinge to prevent the seat from pivoting below the horizontal attitude. An extendable arm is connected at one end to the frame and, at the other end thereof, to the seat between the hinge and the center of gravity. Control means selectively activates extension of the arm to initially vertically elevate the seat in the horizontal attitude, and then to pivot the seat upwardly to assist an individual seated thereon into a standing position; or activates retraction of the arm to initially pivot the seat into a horizontal attitude, and then to vertically lower the seat in a horizontal attitude to assist an individual into a seated position. The extendable arm may be electrically, pneumatically or hydraulically operated, and the device may be portable and adapted to be positioned over a conventional toilet.

31 Claims, 3 Drawing Sheets

FIG. 3
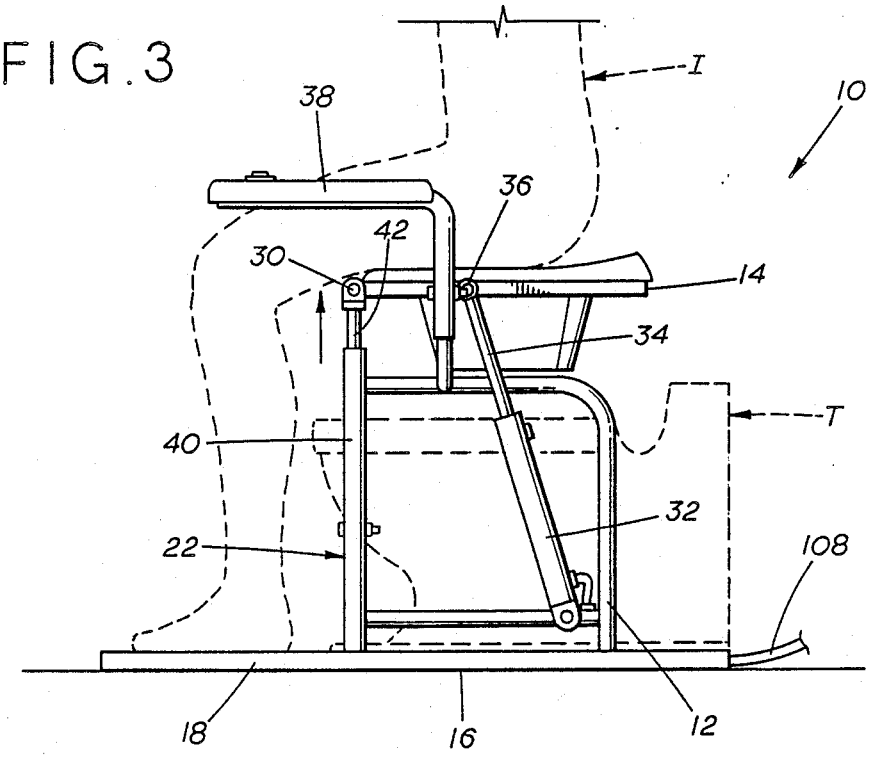
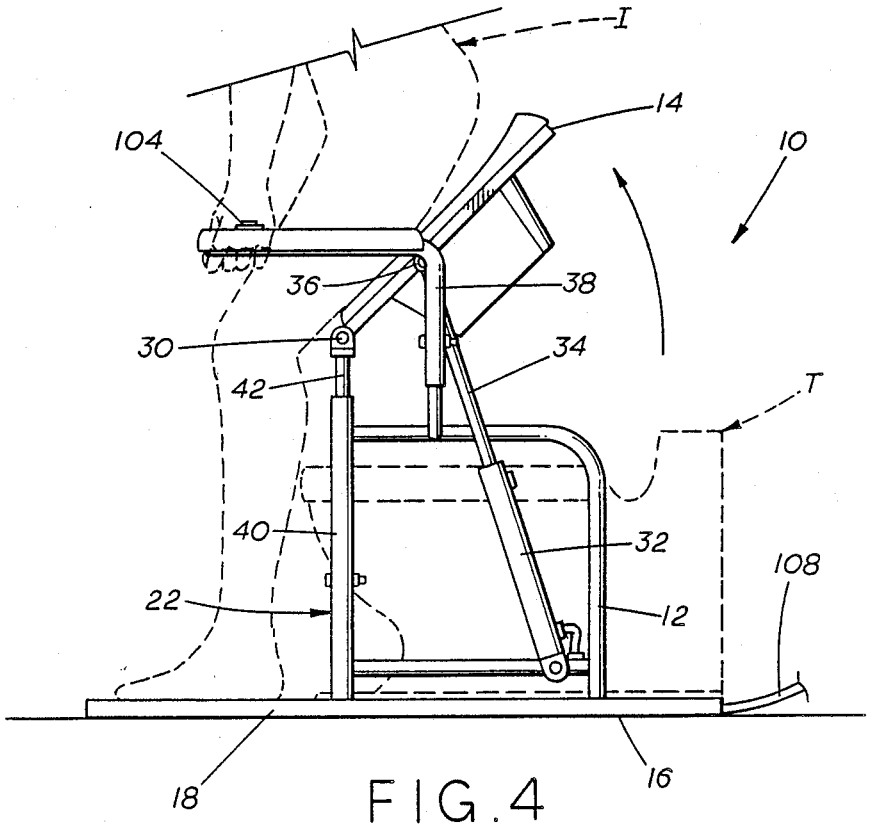
FIG. 4

SEATING ASSISTANCE DEVICE

FIELD OF THE INVENTION

The present invention relates to devices for assisting an individual with a weakened lower body condition from a standing position into a seated position and from a seated position into a standing position, and especially to such devices which assist an invalid in using the toilet.

BACKGROUND OF THE INVENTION

Various devices are known for assisting an invalid into and from a seated position. For example, Hunter in U.S. Pat. No. 3,925,833 describes a hoist assembly designed to be positioned over a toilet. The hoist provided only for vertical movement of the toilet seat. For many invalids, however, vertical movement alone of the seat which remains in a horizontal attitude is insufficient assistance in achieving a seated position. In moving from an upright position into a seated position, an individual must slide onto the vertically elevated, horizontal seat. This requires the knees to be bent to engage the seat with the buttocks and/or a modicum of strength in the upper and lower body in order to slide onto the seat, either in the elevated position or as the seat is being vertically lowered. Moving from a seated position into a standing position is likewise difficult since the individual must have sufficient body strength to push the buttocks from the rear of the seat to the front of the seat.

Other invalid assisting devices pivot the rear of the seat upwardly about an axis at the front of the seat. Burke in U.S. Pat. No. 3,479,087, for example, describes a toilet seat pivotally hinged at the front thereof. This type of device may be useful for a limited number of people depending upon the individual's height and the height of the particular toilet in conjunction with which it is used. However, for relatively tall individuals, such a device may not provide sufficient vertical elevation so that the seat does not provide for sufficient vertical extension of the legs when assuming a seated or standing position therewith. Conversely, when such a device is used with a relatively short individual it may not allow proper placement of the buttocks towards the rear of the seat with the result that the relatively short individual may still be required to use sufficient body strength to horizontally reposition the body once the horizontal position is assumed, i.e. a relatively short individual will end up with the buttocks being positioned towards the front of the seat and must slide the buttocks towards the rear of the seat once the seat has assumed a horizontal position for comfortable seating.

One device described by Epstein in U.S. Pat. No. 4,031,576 simultaneously vertically moves and pivots the seat between standing and seated positions. The rear of the seat is hingedly connected to a support which may be vertically elevated. The front of the seat is hinged to one end of a brace. The other end of the brace is hinged to a support generally in the same vertical plane as the hinge on the rearmost portion of the seat. This seat is elevated and pivoted simultaneously by vertically elevating the rear hinge of the seat. However, since the rear hinge generally remains in the same plane as the end of the brace attached to the frame, pivoting of the seat in this manner obtains a rearward movement of the front of the seat as the rear of the seat is elevated vertically. When using the device to assume a seated position over a toilet, for example, the individual must straddle the toilet with one leg on either side thereof in order to engage the vertically elevated, downwardly pivoted seat with the buttocks. Alternatively, with the feet in front of the toilet, the individual would have to lean and tend to fall backwards to engage the seat with the buttocks. If the initial straddling position is used, then, when the seated position is assumed the feet and calves must, in addition, be moved forward of the toilet from the sides thereof to obtain a comfortable seated position. Similarly, when assuming a standing position from the seated position, one must be careful to place the feet in a straddling position over the toilet before elevating the seat assembly, or else the individual will have to lean backwards against the seat as it is raised with the feet in front of the toilet and push one's body forward to disengage the toilet seat.

Another device described by Cool in U.S. Pat. No. 3,473,174 has a pivot point forward of the foremost end of the seat. Thus, in this device the elevation of the seat results in the forward movement of the seat with respect to the toilet bowl. In addition, the Cool device has several disadvantages such as, for example, that it requires replacement of the conventional seat with the seat attaohed to the assisting device, that the assisting device must be securely attached to the toilet and this requires an installation step, and that the support of the seat in the elevated position uses the toilet for structural stability. Moreover, since the vertical elevation of the seat is simultaneous with the pivoting, an invalid may slide off the seat prematurely during the pivoting process.

SUMMARY OF THE INVENTION

The present invention provides a seating assistance device for invalids for facilitating movement between a standing position and a seated position. In assisting an individual from the seated position into the standing position, the device provides for initial vertical elevation of the seat while the seat is maintained in a horizontal attitude. Once the desired vertical position is obtained, the device provides for pivoting of the seat about an axis at the front of the seat for urging the individual into a standing position. In assisting an invalid from a standing position to a seated position, the individual engages the seat in its elevated, pivoted position with the buttocks. The seat is then initially pivoted into a horizontal position, and subsequently vertically lowered into a comfortable seated position. The device is adapted to be used with any conventional toilet so that no special installation procedures or toilet bowl construction is required, and the seating device is portable.

In one aspect, the invention provides a device for assisting an individual with a weakened lower body condition into and from a seated position. The device includes a frame and a seat member adapted to support the weight of the individual seated thereon. The weight generally defines a longitudinal center of gravity. A hinge means is connected to the seat member adjacent an end thereof forward of the center of gravity for pivoting a rearward portion of the seat member upwardly with respect to a forward portion thereof. Stop means are operatively associated with the hinge means for preventing the rearward seat member portion from pivoting below a horizontal attitude. A means for supporting the hinge means on the frame is vertically slidable between uppermost and lowermost positions. An extendable arm means is pivotably connected to the seat member between the center of gravity and the hinge means for releasably urging the seat member vertically upward. A control means is provided for activating the arm means to raise the seat member in a horizontal attitude with the support means sliding from the lowermost position to the uppermost position. With the support means in the uppermost position, the arm means pivots the seat member about the hinge means to elevate the rearward seat member portion relative to the forward seat member portion. The control means is also adapted to deactivate the arm means to pivot the elevated rearward seat member position about the hinge means into a horizontal attitude with the support means in the uppermost position, and with the seat member in the horizontal attitude, is further adapted to lower the seat member, the support means sliding from the uppermost position to the lowermost position.

In another aspect, the invention provides a device adapted to be used with a toilet bowl for assisting an invalid in using the same. The device includes a frame and a seat member. The frame is designed to be positioned around a conventional toilet bowl with the seat member directly thereabove. The frame has a base and a pair of legs extending upwardly on either side of the toilet bowl adjacent a forward end thereof. The legs are extendable between lowermost and uppermost positions. The seat member has forward and rearward ends, opposite sides generally extending therebetween, and a center of gravity. A pair of pivots hingedly secure the seat member forward end to the legs. The pivots include stop means for maintaining the seat member rearward end at least substantially level with the forward end. An arm has a first end mounted on the frame and a second end connected to the seat member between the forward end and the center of gravity thereof. The device also includes means for selectively extending the arm to urge the seat member from the frame, and releasing the arm extending means to permit the seat to travel vertically downward.

BRIEF DESCRIPTION OF THE DRAWINGS

FIG. 3 is a side elevation of the device of FIGS. 1 and 2 in an intermediate position between the standing and seated positions in which the seat is vertically elevated in a horizontal attitude:

FIG. 4 is a side elevation of the device of FIGS. 1-3 in the uppermost vertical and pivoted position;

DETAILED DESCRIPTION OF THE PREFERRED EMBODIMENTS

Figure 1:
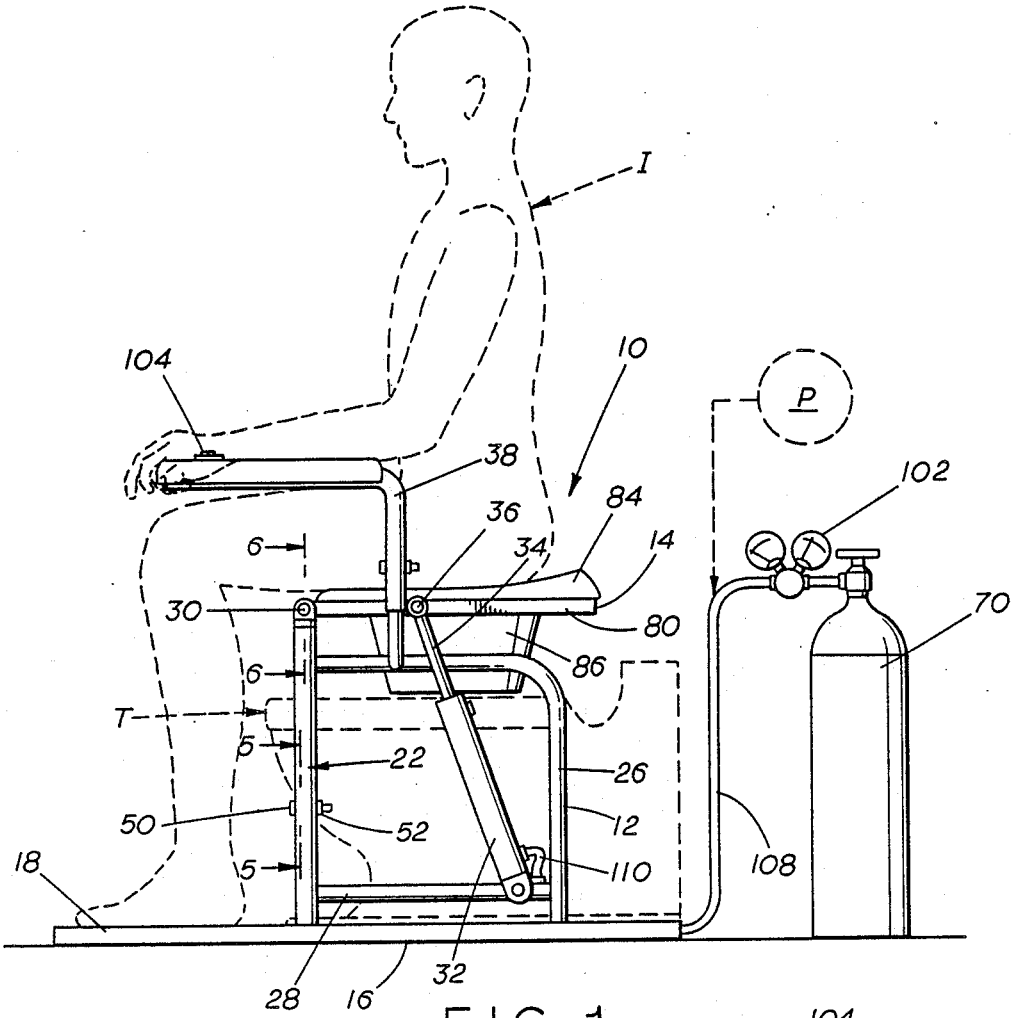
FIG. 1 is a side elevation of a seating assistance device for use with a toilet in accordance with an embodiment of the present invention.

With reference to the drawings, the seating assistance device 10 includes frame 12 and seat member 14 pivotally mounted thereon. The frame 12 includes base 16 having side members 18 extending longitudinally from the front to the back along either side of the frame 16, and transverse member 20 secured therebetween. The base 16 is thus adapted to be positioned around conventional toilet T. Support members or legs 22 extend vertically upward from the longitudinal base members 18. The legs 22 are supported structurally by transverse bar 24 fixedly secured therebetween, side support members 26 which extend vertically upward from the longitudinal base members 18 adjacent the rear of the device and longitudinally to the leg 22, and lower longitudinal bars 28 fixedly secured between each leg 22 and side support member 26. The particular frame and leg configuration is not critical, although it should be sufficient to adequately reinforce and stabilize the legs 22. When it is desired to use the seating assistance device in conjunction with a toilet bowl, the frame 12, base 16 thereof and legs 22 should be configured to fit around the toilet bowl T. It is also preferable for the base 16 to extend longitudinally for a sufficient length from front to back to stabilize the frame to avoid tipping over the device 10 during the seating and standing procedure. The frame 12 is preferably of a tubular, lightweight material such as, for example, aluminum, although any structurally rigid material may be employed as desired.

The seat member 14 is connected to the legs 22 by means of pivots 30. An extendable arm comprises cylinder 32 pivotally connected to the frame 12 and piston rod 34 connected to the seat member 14 at pivot pin 36. Handles or armrests 38 are mounted on the side support members 26 of the frame 12.

Figure 5:
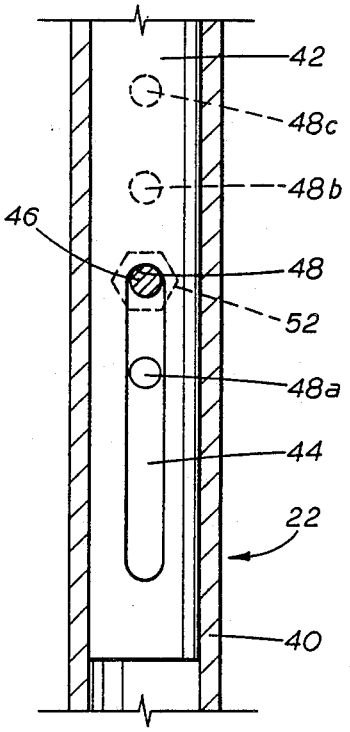
FIG. 5 is a cross-sectional view of a support member of the device of FIG. 1 as seen along the lines 5—5.
Figure 6:
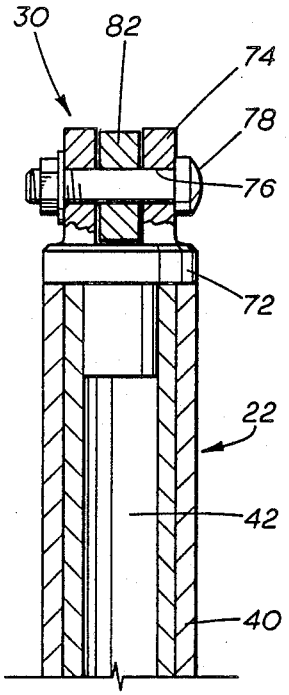
FIG. 6 is a cross-sectional view of a support member in the seating device of FIG. 1 as seen along the lines 6—6.

Each leg 22 includes a lower tubular member 40 and an upper member 42 vertically slidable therein as best seen in FIGS. 3, 5, and 6. The upper leg portion 42 is provided with a milled slot 44 vertically formed therein. The slot 44 receives a bolt 46 positioned through opposing apertures 48 formed in mutual registry in lower leg portion 40. The bolt 46 is secured in position by means of head 50 and threaded nut 52. The bolt 46 serves to limit the vertical movement of the upper leg portion 42 with respect to that of the lower leg portion 40.

Figure 7:
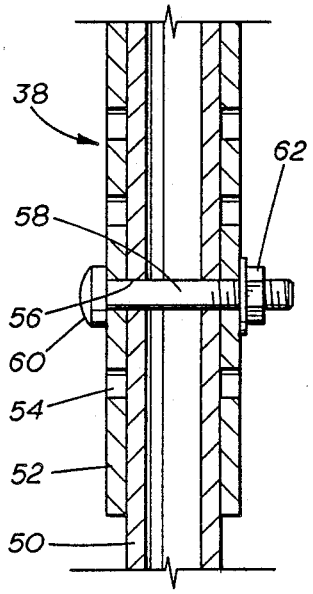
FIG. 7 is a cross-sectional view of a handle support member of the device of FIG. 3 as seen along the lines 7—7.

If desired, the vertical travel of upper leg portion 42 may be made adjustable by providing a series of apertures **48*a*, 48*b*, and 48*c* formed in lower leg portion 40 in vertically spaced relationship. In this manner, the minimum and maximum vertical positions of upper leg portion 42 may be adjusted by positioning the bolt 46 on the desired aperture. Armrest 38 may similarly be made adjustable to suit the height of the individual by means of lower tubular member 50 telescopically received in upper tubular member 52 as illustrated in FIG. 7. The upper armrest portion 52 is provided with a plurality of vertically spaced perforations 54 formed in mutual registry on opposite sides of the upper armrest portion 52. The lower armrest portion 50 has a similar perforation 56 formed therein. A bolt 58 is received through the desired pair of perforations 54 and the pair of perforations 56 and is secured by means of head 60 and opposed nut 62 threadedly received on the bolt 58. The armrest 38 is preferably secured to the frame 12 so that it will remain in a fixed position relative thereto, although it is also contemplated that the arm rest could be mounted rotatably about a vertical axis, or to the seat member 14**.

As mentioned above, seat member 14 is hingedly connected to leg 22 by means of pivot 30. Pivot 30 is securely mounted atop upper leg portion 42 as is best illustrated in FIG. 6. The pivot 30 includes collar 72 and a pair of opposed lugs 74 extending vertically therefrom. The lugs 74 have opposed bores 76 for receiving the pivot pin 78 therein. The seat member 14 includes a support member 80 which terminates adjacent the forward end of the seat 14 in perforated lug 82 which receives the pivot pin 78 and is positioned between the pivot lugs 74. The crown 72 serves as a stop means so that the lug 82 and/or the support member 80 abut the collar 72 when the seat member 14 is in a horizontal position. This arrangement prevents the seat member 14 from pivoting downwardly about pivot 30 when the seat member 14 is supported only by the legs 22 in the pivots 30. If desired, the seat member 14 may also include a contoured seating cushion or cover 84 for greater comfort. The seat member 14 may further be provided with a funnel 86 to aid in directing bodily waste into the toilet bowl T. In any case, seat member 14 is preferably sufficiently elevated in its lowermost position so that it does not interfere with the positioning of the device 10 about the toilet bowl T.

In the operation of the device 10 in assisting a seated individual in assuming a standing position, the cylinder 32 is actuated with a hydraulic fluid or compressed gas as will be explained in more detail hereinbelow. This causes the piston rod 34 to be urged outwardly from the cylinder 32. In turn, this urges the seat member 14 upward at pivot 36. Since the pivot 36 is located forward of the center of gravity of the seat member 14 and the weight of the individual I seated thereon, the seat member 14 will remain in a horizontal position while the upper leg portion 42 slides vertically with respect to lower leg portion 40. It is readily appreciated that the mounting of the piston rod 34 at pivot 36 must be positioned forward of the center of gravity in order to maintain the seat member 14 in a horizontal attitude during elevation to the uppermost vertical position illustrated in FIG. 3. If the pivot 36 were located behind the center of gravity, the seat member 14 would be tilted forward before vertically elevating.

When the uppermost vertical elevation of the seat member 14 with respect to the frame 12 is obtained (see FIG. 3), the upper leg portion 42 will similarly be in its uppermost vertical position with respect to the lower leg portion 40 with the bolt 46 stopped in the lower end of the slot 44. Further urging of the piston rod 34 from the cylinder 32 then pivots the seat member 14 so that it tilts forward as illustrated in FIG. 4, assisting the individual I into a standing position.

To assist a standing individual into a seated position, the foregoing procedure is reversed. With the seat member 14 in its uppermost and pivoted position (see FIG. 4), the individual positions himself or herself to engage the seat member 14 with the buttocks. The compressed gas or hydraulic fluid is then vented from the cylinder 32, the seat member 14 pivots back to the horizontal position (see FIG. 3), and then the seat member 14 is vertically lowered until the upper end of the slot 44 of upper leg portion 42 abuts the bolt 46 corresponding to the lowermost vertical position (see FIGS. 1 and 2).

Figure 2:
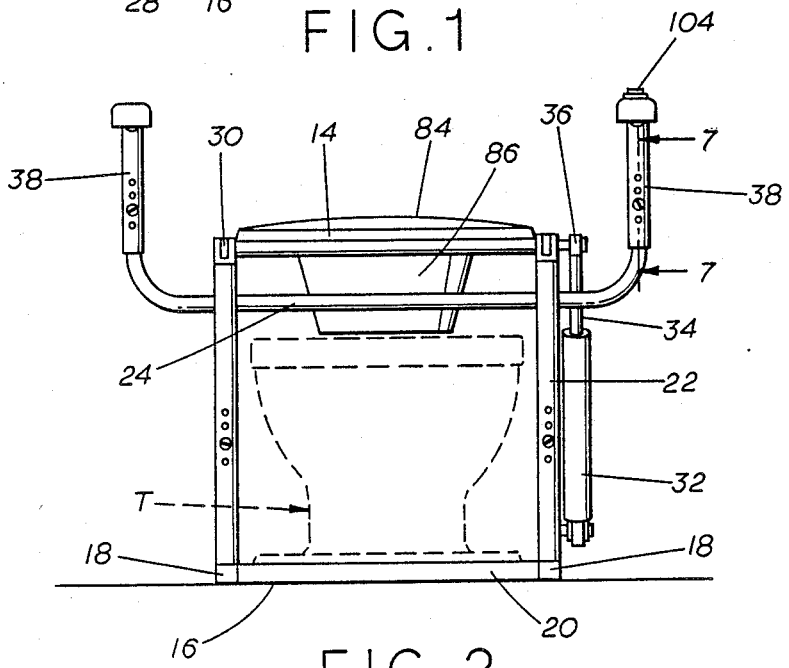
FIG. 2 is a front elevation of the seating assistance device of FIG. 1.
Figure 8:
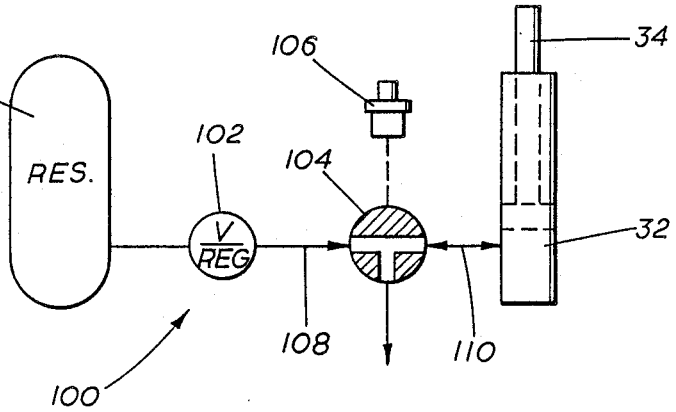
FIG. 8 is a schematic diagram of a fluid system used for operation of the device of FIG. 1.

A pneumatic system 100 for operation of the device 10 is illustrated in FIG. 8 in which like parts bear like reference numerals. The pneumatic system 100 includes reservoir 70 of a compressed gas such as air or nitrogen, pressure regulator 102, valve 104, valve switch 106 and cylinder 32. Pressurized gas is supplied from the reservoir 70 through the valve regulator 102 to the valve 104. The pressure reservoir 70 and the valve regulator 102 are conventional and may for example, be a standard 40 (at standard conditions) cubic foot cylinder which is typically supplied compressed at a pressure of about 2200 psi. It has been found that a conventional 40 cubic foot tank of air or nitrogen is sufficient to operate the device 10 through approximately 500–600 lifting cycles. Since such tanks may be made of aluminum and are therefore relatively light, this also adds to the portability of the device 10. The valve 104 is a conventional three-way valve which is operated by the valve switch 106 which is likewise well known. The valve switch 106 may be conveniently mounted in the armrest 38 as illustrated in FIG. 1. The valve 104 has one port connected to the pressurized gas from the valve regulator 102, a second port in fluid communication with the cylinder 32, and a third port which functions as a vent. The line 106 from the pressure regulator 102 to the valve 104, as well as in the line 108 from the valve 104 to the cylinder 32, may conveniently be routed through the frame 16 which may, as mentioned hereinabove, be of a tubular construction which facilitates such routing. There are desirably flow restriction orifices in the line 110, as well as the vent line from the valve 104.

In operation of the pneumatic system 100, pressure regulator 102 will make available to the valve 104 compressed gas at a set pressure. The valve 104 is normally closed to the compressed gas line 108 to prevent the escape of the compressed gas, while the cylinder 32 is maintained in communication with the vent line of the valve 104 so that the device 10 is in the "seated" position. Upon actuation of the valve switch 106, the valve is operated so that the pressurized gas from the valve regulator 102 is placed in fluid communication with the cylinder 32, while at the same time the vent from the valve 104 is closed. This causes the cylinder 32 to become filled with the gas and to push the piston rod 34 outwardly therefrom to elevate the seat member 14 as described hereinabove. The rate of ascent of the seat member 14 is generally controlled by the rate at which the cylinder 32 is filled with the compressed gas, which rate in turn may be conveniently controlled by adjustment of the pressure regulator 102 and/or adjustment or sizing of an orifice in the line 110 between the valve 104 and the cylinder 32. In this manner, the seating device 10 may be adjusted for use with individuals of varying weights so that the individual is not elevated to the standing position too rapidly or too slowly.

The descent of the seat member 14 from the elevated and pivoted position (FIG. 4) into the seated position is initiated by operation of the valve switch 106 to close off the source of the pressurized gas and vent the cylinder 32. The rate of descent of the seat member 14 is, of course, controlled by the rate at which the gas from the cylinder 32 is vented through the valve 104, which in turn, may be controlled by an adjustable orifice positioned in the venting port at the valve 104. In this manner, the rate of descent can be adjusted depending on the weight of the individual using the device so that the descent of the seat member 14 is neither too rapid nor too slow.

Figure 9:
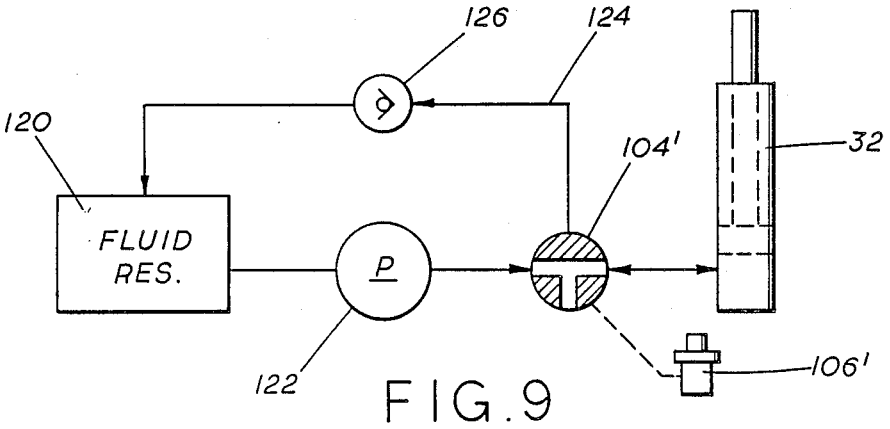
FIG. 9 is a schematic illustration of a hydraulic system for operating a seating assistance device according to the present invention.

An alternative control system employing a hydraulic fluid is illustrated schematically in FIG. 9. The operation of the hydraulic system is similar to that of the pneumatic system illustrated in FIG. 8 and discussed hereinabove, except that a hydraulic fluid is used instead of a compressed gas source. In this system, the hydraulic fluid from reservoir 120 is pressurized by means of a pump 122 and fed to the three-way valve 104'. Instead of venting the three-way valve 104', return line 124 is provided for returning the fluid from the cylinder 32 to the hydraulic fluid reservoir 120 through a restriction orifice 126 provided to control the rate of descent.

It is also contemplated that other mechanisms or systems for controlling the ascent and descent of the seat member 14 may be employed, such as, for example, an electric screw jack provided in place of the cylinder 32 and the piston rod 34.

Having described various embodiments of the invention hereinabove, other embodiments within the scope of the present invention will become apparent to those skilled in the art. It is intended that all such variations be encompassed by the claims which follow.

What is claimed is:

1. A device for assisting an individual with a weakened lower body condition into and from a seated position, comprising:

a frame;

a seat member adapted to support the weight of the individual seated thereon, said seat member generally defining a longitudinal center of gravity;

hinge means connected to said seat member adjacent to an end thereof forward of said center of gravity for pivoting a rearward portion of said seat member upwardly with respect to a forward portion thereof;

stop means operatively associated with said hinge means for preventing said rearward seat member portion from pivoting below a horizontal attitude;

means for supporting said hinge means on said frame, said support means being vertically slidable between uppermost and lowermost positions;

extendable arm means pivotally connected to said seat member forward of said center of gravity for releasably urging said seat member vertically upward; and control means for activating said arm means to raise said seat member in a horizontal attitude with said support means sliding from said lowermost position to said uppermost position, and with said support means in said uppermost position, to pivot said seat member about said hinge means to elevate said rearward seat member portion relative to said forward seat member portion, and for deactivating said arm means to pivot said elevated rearward seat member portion about said hinge member into a horizontal attitude with said support means in said uppermost position, and with said seat member in said horizontal attitude to lower said seat member with said support means sliding from said uppermost position to said lowermost position.

2. The device of claim 1, wherein the frame is adapted to position the seat member above a toilet bowl.

3. The device of claim 1, wherein the hinge means includes a first and second pivot positioned adjacent sides of said forward seat member portion.

4. The device of claim 3, wherein said stop means includes a surface formed on said support means adjacent said pivots to engage a longitudinal bottom surface of said seat member in said horizontal attitude.

5. The device of claim 1, wherein said support means includes a telescopic leg extending upward from said frame.

6. The device of claim 1, wherein said uppermost and lowermost positions between which said hinge support means are slidable are adjustable.

7. The device of claim 1, wherein said arm means is electrically extendable.

8. The device of claim 1, wherein said arm means is hydraulically extendable.

9. The device of claim 1, wherein said arm means is pneumatically operable.

10. The device of claim 8 or 9, wherein said arm includes a piston slidable in a cylinder adapted to receive a pressurized fluid.

11. The device of claim 10, wherein said fluid pressure is adjustable to control the rate at which said arm is extended.

12. The device of claim 10, wherein said control means includes a valve means for selectively introducing said pressurized fluid into said cylinder and removing said fluid therefrom.

13. The device of claim 12, including means for adjusting the rate of removal of said fluid from said cylinder.

14. The device of claim 1, further comprising:

handles secured to said frame and adapted to be grasped for support by an individual using said device.

15. A device adapted to be used with a toilet bowl for assisting an invalid in using the same comprising:

a frame adapted to be positioned adjacent the toilet bowl, said frame having a base and a pair of support members extending upwardly on either side of the toilet bowl adjacent a forward end of the toilet bowl, said support member being vertically extendable between lowermost and uppermost positions;

a seat member having a forward end, a rearward end, opposite sides extending therebetween, and a center of gravity;

a pair of pivots hingedly securing said seat member forward end to said support members, said pivots being vertically extendable with said support members and including stop means for preventing said seat member rearward end from pivoting downwardly below a position substantially level with said forward end;

an arm having a first end mounted on said frame and a second end secured to said seat member between said forward end and said center of gravity; and means for selectively extending said arm to urge said seat member from said frame and retracting said arm to urge said seat member toward said frame.

16. The device of claim 15, wherein said base includes side members adapted to rest on a floor and extending longitudinally away from the position of said support members sufficiently to stabilize the device.

17. The device of claim 16, wherein said base includes a transverse member secured to said side members.

18. The device of claim 17, wherein said first arm end is pivotally attached to said base longitudinally rearward of said center of gravity.

19. The device of claim 18, wherein said second arm end is pivotally attached to said seat member.

20. The device of claim 15, wherein each of said support members includes a tubular portion, second portion slidable therein, and stop means for limiting vertical movement of said second portion corresponding to said lowermost and uppermost positions.

21. The device of claim 20, wherein said stop means comprises a vertical slot formed in said support member second position and a bolt secured to said tubular portions and received in said slot.

22. The device of claim 21, wherein the vertical position of said bolt is adjustable.

23. The device of claim 20, wherein said tubular portion is secured to said base and said second support member position is secured to a pivot securing said seat member.

24. The device of claim 15, wherein said arm extending means includes a cylinder attached to one of said ends of said arm and a piston slidable in said cylinder attached to the other said end of said arm, said cylinder adapted to receive a pressurized fluid to urge said piston outwardly therefrom.

25. The device of claim 24, wherein said arm retraction means comprises means for venting said fluid from said cylinder.

26. The device of claim 25, wherein said venting means is adjustable.

27. The device of claim 26, wherein said selective arm extension and retraction means includes a three-way valve having a first position for introducing said fluid from a pressurized source thereof into said cylinder, and a second position for venting said fluid from said cylinder.

28. The device of claim 27, further comprising handles mounted on said frame and positioned for grasping by an individual seated on said seat member.

29. The device of claim 28, further comprising means for controlling said valve mounted on said handle.

30. The device of claim 27, further comprising a pressurized fluid source.

31. The device of claim 30, wherein said fluid is compressed air or nitrogen.

* * * * *